US006491498B1

(12) United States Patent
Seleski et al.

(10) Patent No.: US 6,491,498 B1
(45) Date of Patent: Dec. 10, 2002

(54) TURBINE BLADE POCKET SHROUD

(75) Inventors: Richard Seleski, Palm Beach Gardens, FL (US); Remo Chiurato, Jupiter, FL (US)

(73) Assignee: Power Systems MFG, LLC., Jupiter, FL (US)

( * ) Notice: Subject to any disclaimer, the term of this patent is extended or adjusted under 35 U.S.C. 154(b) by 0 days.

(21) Appl. No.: 09/971,241

(22) Filed: Oct. 4, 2001

(51) Int. Cl.[7] ..... F01D 5/22

(52) U.S. Cl. ..... 416/191; 416/190; 416/192; 416/92; 416/97 R; 415/173.4; 415/173.5; 415/173.6

(58) Field of Search ..... 416/189, 190, 416/191, 192, 195, 92, 97 R; 415/173.4, 173.5, 173.6, 228

(56) References Cited

U.S. PATENT DOCUMENTS 4,326,836 A 4/1982 Fitton
4,533,298 A 8/1985 Partington et al.
4,710,102 A 12/1987 Ortolano
5,154,581 A * 10/1992 Borufka et al ..... 416/190
5,211,540 A 5/1993 Evans
5,609,470 A * 3/1997 Dodd ..... 416/192
5,971,710 A * 10/1999 Stauffer et al. ..... 416/191
6,164,916 A * 12/2000 Frost et al. ..... 416/189
6,179,567 B1 * 1/2001 Stauffer et al. ..... 416/191
6,241,471 B1 6/2001 Herron
6,340,284 B1 * 1/2002 Beeck et al. ..... 416/189

* cited by examiner

*Primary Examiner*—Christopher Verdier
(74) *Attorney, Agent, or Firm*—Brian R. Mack; Christopher T. Hayes

(57) ABSTRACT

An improved gas turbine blade is disclosed that utilizes a blade tip shroud with tapered shroud pockets to remove excess weight from the shroud while not compromising shroud bending stresses. Excess shroud weight removed by the tapered pockets reduces overall blade pull while maintaining material necessary to increase shroud stiffness. The resulting rib created between the tapered pockets provides a surface, away from possible areas of stress concentration, for drilling radial cooling holes.

11 Claims, 4 Drawing Sheets

TURBINE BLADE POCKET SHROUD

BACKGROUND OF THE INVENTION

1. Field of the Invention

This invention relates to shrouded turbine blades and more specifically to the mass reduction of shrouded turbine blades while not compromising the resistance to shroud bending stresses.

2. Description of Related Art

Gas turbine blades are rotating airfoil shaped components in series of stages designed to convert thermal energy from a combustor into mechanical work of turning a rotor. Performance of a turbine can be enhanced by sealing the outer edge of the blade tip to prevent combustion gases from escaping from the flowpath to the gaps between the blade tip and outer casing. A common manner for sealing the gap between the turbine blade tips and the turbine casing is through blade tip shrouds. Not only do shrouds enhance turbine performance, but they serve as a vibration damper, especially for larger, in radial length, turbine blades. The shroud acts as a mechanism to raise the blade natural frequency and in turn minimizes failures due to extended resonance time of the blade at a natural frequency. A portion of a typical turbine blade with a shroud is shown in FIG. 1. The figure shows turbine blade 10 with an airfoil section 11 and shroud 12. The shroud is manufactured integral to the airfoil 11. The airfoil further contains a leading edge 15 and trailing edge 16 that run generally perpendicular to shroud 12. Shroud 12 has a thickness and has sidewalls 17, which are cut to create an interlocking configuration when adjacent turbine blades are present. The interlocking mechanism occurs along two bearing faces 13. That is, along bearing face 13 is where adjacent turbine blades (not shown) contact shroud 12. It is the interlocking of the turbine blade shrouds 12 at bearing faces 13, that creates the means for damping out vibrations as well as for sealing the hot combustion gases within the turbine gas-path. An additional feature of a typical turbine blade shroud is knife edge 14. Depending upon the size of the blade shroud, one or more knife edges may be utilized. These seals run parallel to each other, typically perpendicular to the engine axis, and extend outward from shroud 12. The purpose of these seals is to engage the shroud blocks of the turbine casing (not shown) to further minimize any leakage around the blade tip. While the purpose of the shroud is to seal the combustion gases within the flow path as well as to provide a means to dampen vibrations, the shroud has its disadvantages as well.

A drawback to the shroud concept is the weight the shroud adds to the turbine blade. During operation, the turbine blades spin on a disk, about the engine axis. A typical industrial application includes disk speeds up to 3600 revolutions per minute. The blades are held in the disk by an interlocking cut-out between the blade root and the disk. As the turbine blade spins, the centrifugal forces cause the blade to load outward on the turbine disk at this attachment point. The amount of loading on the disk and hence the blade root, which holds the blade in the disk, is a function of the blade weight. That is, the heavier the blade, the more load and stresses are found on the interface between the blade root and disk, for a given revolutions per minute. Excessive loading on the blade root and disk can reduce the overall life of each component.

Another drawback to shrouds is creep curling of the blade shrouds. Depending on the thickness of the shroud, the shroud edges can "curl" up at their ends and introduce severe bending stresses in the fillets between the shroud and blade tip. Shrouds curl due to the bending load on the edges of the shroud from gas pressure loads as well as centrifugal loads. The curling of a shroud is analogous to the bending of a cantilevered beam due to a load at the free end of the beam. An industry known fix to this curling phenomenon is to increase the section thickness of the shroud uniformly which will result in a stiffer shroud and more resistance to curling. The downside to simply increasing the shroud thickness uniformly is the additional weight that is added to the shroud by this additional material.

OBJECTS OF THE INVENTION

It is an object of the present invention to provide an improved turbine blade shroud that reduces the overall blade mass, which in turn reduces the amount of pull on the turbine disk, increasing the life of both the turbine blade root and corresponding disk locations.

It is a further object of the present invention to provide an improved turbine blade shroud that does not compromise shroud bending stresses or mass balance of the shroud.

It is yet another object of the present invention to provide an improved turbine blade shroud that includes a rib section along the shroud for drilling cooling holes such that no high stress concentrations occur from these cooling holes.

In accordance with these and other objects, which will become apparent hereinafter, the instant invention will now be described with particular reference to the accompanying drawings.

The present invention addresses the issue of eliminating shroud curling while reducing shroud weight, and hence, overall turbine blade weight and not compromising shroud bending stresses. The improved shroud structure removes mass from the shroud while not compromising the structural integrity or performance requirements of the shroud or the overall blade structure. The excess mass is removed by inserting ramped pockets on the outermost surface of the shroud at locations where the mass is not necessary to reduce stress levels at the airfoil to shroud transition.

DETAILED DESCRIPTION OF THE PREFERRED EMBODIMENT

Figure 1:
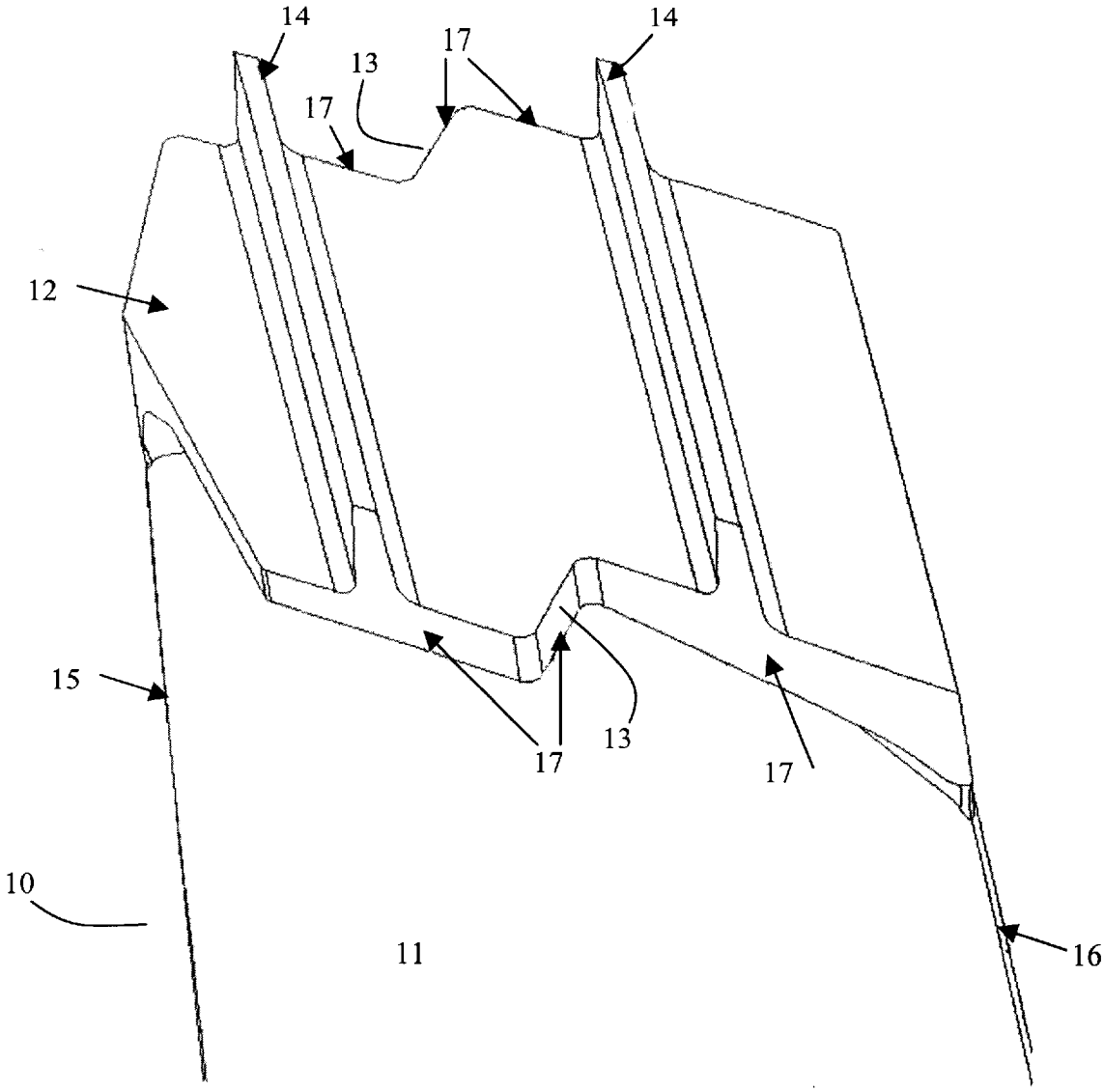
FIGURE 1. PRIOR ART
FIG. 1 is a perspective view of a typical turbine blade shroud.
Figure 2:
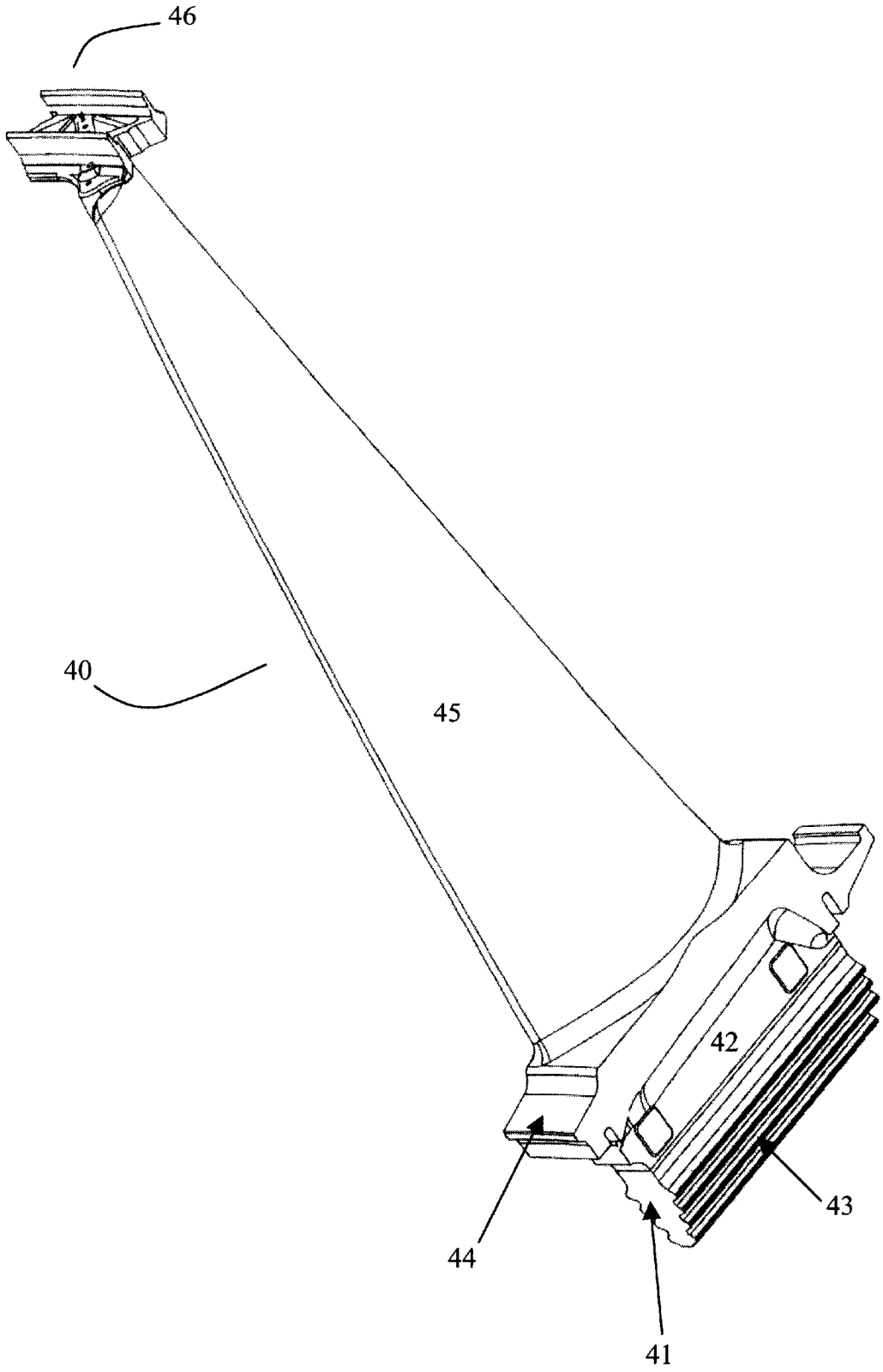
FIG. 2 is a perspective view of the turbine blade and shroud of the present invention.

The preferred embodiment of the improved turbine blade is shown in FIG. 2. Turbine blade 40 is cast as a single piece construction with multiple details machined into the casting. The turbine blade is comprised of a root section 41, that may contain a neck area 42, outward from said root section. Root section 41 contains machined surfaces 43 that match the profile of the turbine disk (not shown) for interlocking said blade root and said turbine disk such that the turbine blade 40 is contained with the turbine disk under centrifugal loads. Outward of said blade root and neck region is a platform section 44, which is generally planar in shape and connected to root section 41. Extending outward from platform 44 is an airfoil 45. The airfoil has an end connected to platform 44 and a tip end, which is connected to a shroud 46. The shroud 46 is shown in greater detail in FIG. 3.

Figure 3:
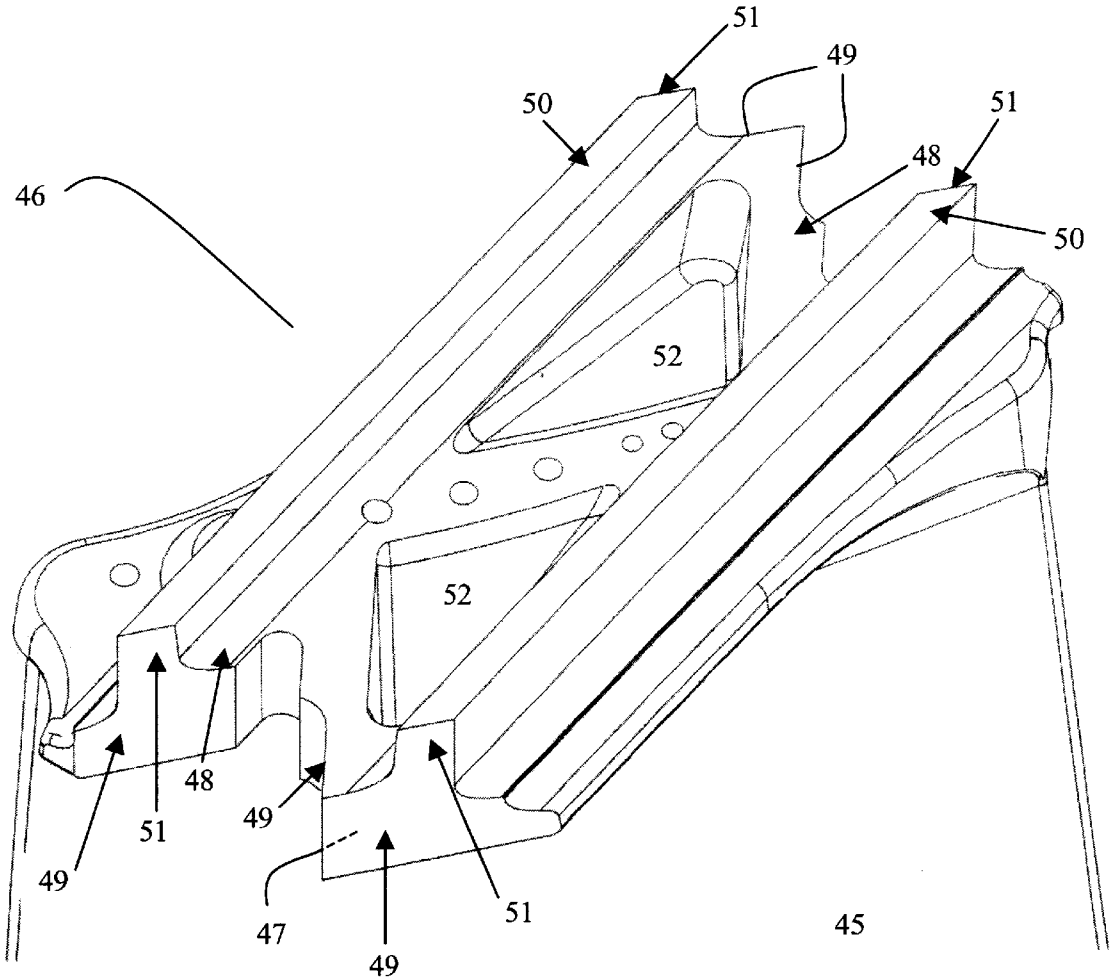
FIG. 3 is a perspective view of the shroud portion of the present invention.

FIG. 3 shows the tip of airfoil 45 along with shroud 46. The shroud extends outward from airfoil 45 and contains a first surface 47 that is fixed to the tip and contoured to the airfoil tip as well as second surface 48 outward of and parallel to surface 47. Connecting o surfaces 47 and 48 are a plurality of radially extending sidewalls 49 that are generally perpendicular to surfaces 47 and 48. The surfaces and sidewalls give shroud 46 its thickness that is addressed by the present invention. Shroud 46 also contains knife edges 50 extending outward from surface 48. Knife edges 50 run across surface 48 and terminate at ends 51, which are coincident with sidewalls 49. An additional feature of shroud 46 is recessed pockets 52 in surface 48 and adjacent knife edges 50. The recessed pockets 52 are separated by a rib 53 and are tapered in depth, with the pockets deepest at regions adjacent the sidewalls 49 and knife edge ends 51. In the preferred embodiment the improved turbine blade contains two triangular shaped recessed pockets separated by a rib section. Recessed pockets 52 are cast into shroud 46 to remove excess material not required for improved shroud stiffness. This removed material reduces the overall shroud weight and as a result, reduces the amount of blade pull on the turbine disk, as discussed earlier. The material is removed in a tapered fashion such that material necessary to reduce shroud bending stresses, through improved section thickness, which is adjacent rib 53 remains, where as material that is not needed to reduce shroud bending stresses is removed.

Figure 4:
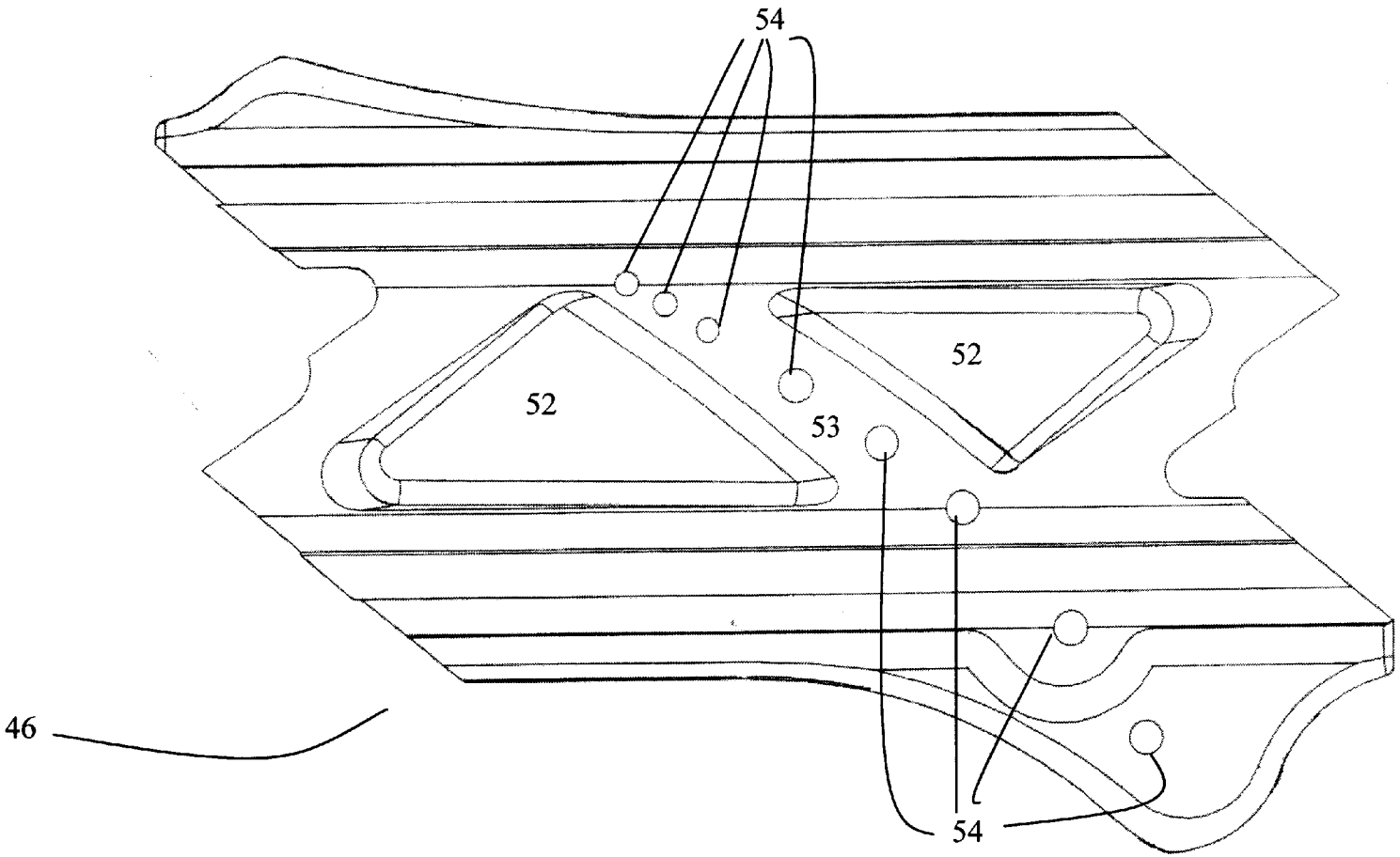
FIG. 4 is a top elevation view of the shroud portion of the present invention.

FIG. 4, shows a top elevation view of shroud 46 with recessed pockets 52, separated from each other by rib 53. Depending upon engine operating conditions, air or steam cooling of the turbine blade may be required. If such cooling is required, a plurality of cooling holes 54 extending from rib 53 of shroud 46 to cooling passages within the airfoil platform, and blade root section can be machined into the turbine blade. Rib 53 provides a flat plane section for drilling the cooling holes. This rib will ensure that the holes 54 are located far enough away from the recessed shroud pockets so that fillets and corners of the recessed pockets are not cut during drilling of the cooling holes, thereby avoiding the undesirable stress concentrations that can result from sharp corners at the interface of a fillet/corner and the edge of a cooling hole.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. An improved turbine blade comprising:

a root section, a platform section of generally planar shape connected to said root, an airfoil extending outward from said platform, said airfoil having a platform end connected to said platform, and a tip end opposite said platform end, a shroud extending outward from said tip end and attached thereto, said shroud comprising:

a first surface fixed to said tip end of said airfoil;

a second surface in spaced relation to and generally parallel to, said first surface;

a plurality of radially extending sidewalls, generally perpendicular to, and connecting said first and second surfaces;

a pair of knife edges extending outward from said second surface, each of said knife edges extending across said second surface and having knife ends at said sidewalls;

at least one recessed pocket in said second surface, said pocket extending towards said first surface to a predetermined depth wherein each of said at least one recessed pockets varies in depth from the center of said shroud towards said radially extending sidewalls, with the deepest location of each of said at least one recessed pockets immediately adjacent said knife ends.

2. The improved turbine blade of claim 1 wherein each of said at least one recessed pockets is generally triangular in shape.

3. The improved turbine blade of claim 1 wherein each of said at least one recessed pockets is located adjacent said knife edges.

4. The improved turbine blade of claim 1 wherein each of said at least one recessed pockets varies in depth from the center of the shroud towards said radially extending sidewalls, with the deepest location of each of said at least one recessed pockets immediately adjacent one of said sidewalls.

5. The improved turbine blade of claim 1 wherein each of said at least one recessed pockets are separated by a rib which extends between said knife edges and is fixed to said second surface, said rib including a plurality of cooling holes, said cooling holes extending from said rib towards said root and through said turbine blade.

6. The improved turbine blade of claim 1 wherein said radially extending sidewalls of said shroud are configured in a "Z"-like shape.

7. An improved turbine blade comprising:

a root section, a platform section of generally planar shape connected to said root, an airfoil extending outward from said platform, said airfoil having a platform end connected to said platform, and a tip end opposite said platform end, a shroud extending outward from said tip end and attached thereto, said shroud comprising:

a first surface fixed to said tip end of said airfoil;

a second surface in spaced relation to and generally parallel to, said first surface;

a plurality of radially extending sidewalls, generally perpendicular to, and connecting said first and second surfaces;

at least one knife edge extending outward from said second surface, said at least one knife edge extending across said second surface and having ends at said sidewalls;

at least one recessed pocket in said second surface, said at least one pocket extending towards said first surface to a predetermined depth, having a generally triangular shape, and is located adjacent said knife edge.

8. The improved turbine blade of claim 7 wherein each of said at least one recessed pockets varies in depth from the center of the shroud towards said radially extending sidewalls, with the deepest location of each of said at least one recessed pockets adjacent said ends of said knife edge.

9. The improved turbine blade of claim 8 wherein each of said at least one recessed pockets varies in depth from the center of the shroud towards said radially extending sidewalls, with the deepest location of each of said at least one recessed pockets adjacent one of said sidewalls.

10. The improved turbine blade of claim 9 wherein each of said at least one recessed pockets are separated by a rib which extends generally perpendicular across said knife edge and is fixed to said second surface, said rib including a plurality of cooling holes, said cooling holes extending from said rib towards said root and through said turbine blade.

11. The improved turbine blade of claim 9 wherein said radially extending sidewalls of said shroud are configured in a "Z"-like shape.

* * * * *